United States Patent [19]

Seifert

[11] 4,320,784

[45] Mar. 23, 1982

[54] MOUNTING FOR A TENSION BEAM

[75] Inventor: Eberhard Seifert, Rickenbach, Switzerland

[73] Assignee: Sulzer Brothers Limited, Winterthur, Switzerland

[21] Appl. No.: 124,731

[22] Filed: Feb. 26, 1980

[30] Foreign Application Priority Data

Mar. 1, 1979 [CH] Switzerland ..... 2032/79

[51] Int. Cl.[3] ..... D03D 49/22

[52] U.S. Cl. ..... 139/114

[58] Field of Search ..... 139/109, 110, 114, 115; 242/75

[56] References Cited

U.S. PATENT DOCUMENTS 2,375,316 5/1945 Moessinger ..... 139/110
2,398,547 4/1946 Moessinger ..... 139/114
2,920,659 1/1960 Pfarrwaller ..... 139/110
3,921,676 11/1975 Pech et al. ..... 139/110

FOREIGN PATENT DOCUMENTS 221332 2/1909 Fed. Rep. of Germany ..... 139/114

*Primary Examiner*—Henry Jaudon
*Attorney, Agent, or Firm*—Kenyon & Kenyon

[57] ABSTRACT

The mounting for the tension beam uses a connection means whereby the point of connection of the spring to the tension lever can be adjusted during operation. The connection means includes a toothed member in the form of a serration on the arm of the tension lever and a tooth element in the form of a rotatable pinion which is disposed at the end of a draw fork connected to the spring. A releaseable clamping means is also provided to prevent rotation of the pinion.

13 Claims, 3 Drawing Figures

MOUNTING FOR A TENSION BEAM

This invention relates to a mounting for a tension beam of a textile machine. More particularly, this invention relates to a mounting for a tension beam of a weaving machine.

Heretofore, it has been known to provide textile machines such as weaving machines with a tension beam over which warp threads can be directed. In many cases, the tension beam has been mounted on levers or the like which can be adjusted so as to change the tension in the warp threads. For example, as described in Swiss Pat. No. 400,036, it has been known to mount a tension beam on a mounting which includes a two-arm lever which is pivotable about a given axis with one arm of the lever supporting the tension beam and the other arm being connected to an accumulator, such as a spring, for generating a tension force. In this case, the arm to which the accumulator is connected carries a serration which cooperates with two bolts on the end of a pull rod which is connected to the spring. In order to adjust the tension or the torque exerted on the tension lever, the two-arm tension lever must be pivoted into a tensionless position. Thereafter, the bolts can be shifted from one tooth gap into another tooth gap to adjust the tension. The lever can then be returned to the tensioned position. However, an adjustment of the tension in the tension beam or of the torque on the tension lever is relatively complicated and is difficult or impossible during maintanance of the tensioned position of the tension beam, i.e. while tension is on the warp threads.

Accordingly, it is an object of the invention to provide a mounting for a tension beam which can be easily manipulated to adjust the tension of a tension beam in a textile machine.

It is another object of the invention to provide a relatively simple mounting for a tension beam of a weaving machine.

It is another object of the invention to provide for the adjustment of the tension of a tension beam during operation of a weaving machine.

It is another object of the invention to provide a mounting arrangement for a tension beam which can be adjusted with tensioned warped threads on the tension beam.

Briefly, the invention provides a mounting for a tension beam of a textile machine such as a weaving machine. The mounting is comprised of a pivotally mounted tension lever having one arm for receiving a tension beam, an accumulator for pivoting the lever in a given direction and a steplessly adjustable connection means between the accumulator and a second arm of the lever for adjusting the point of connection of the accumulator to the second arm of the lever in order to adjust the tension of a tension beam on the lever.

In one embodiment, the connection means includes a means such as a serration on the second arm of the tension lever and a tooth element, such as a pinion, connected to the accumulator in meshing engagement with the serration. The tooth element steplessly cooperates with the serration so as to permit adjustment of a torque exerted by the accumulator on a tension beam mounted on the tension lever.

The mounting allows the torque on the tension beam to be adjusted, as a rule, without bringing the tension beam into a tensionless position. Further, warp threads on the tension beam can be maintained substantially under existing operational tension conditions.

In order to adjust the torque, the tooth element is set in rotation so that the point of engagement at the serration changes and the active lever arm at the tension lever can be increased or reduced. The torque exerted by the accumulator is then increased or decreased accordingly.

In other embodiments, the connection means may include a tooth member on the arm of the tension lever in the form of a serration and a rotatable tooth element in the form of a worm, or a toothed member which is threaded and a tooth element which is in the form of a screw.

In addition, a suitable clamping means may be incorporated in the connection means to restrain rotation of the tooth element during operation of the machine.

These and other objects and advantages of the invention will become more apparent from the following detailed description and appended claims taken in conjunction with the accompanying drawings in which:

Figure 1:
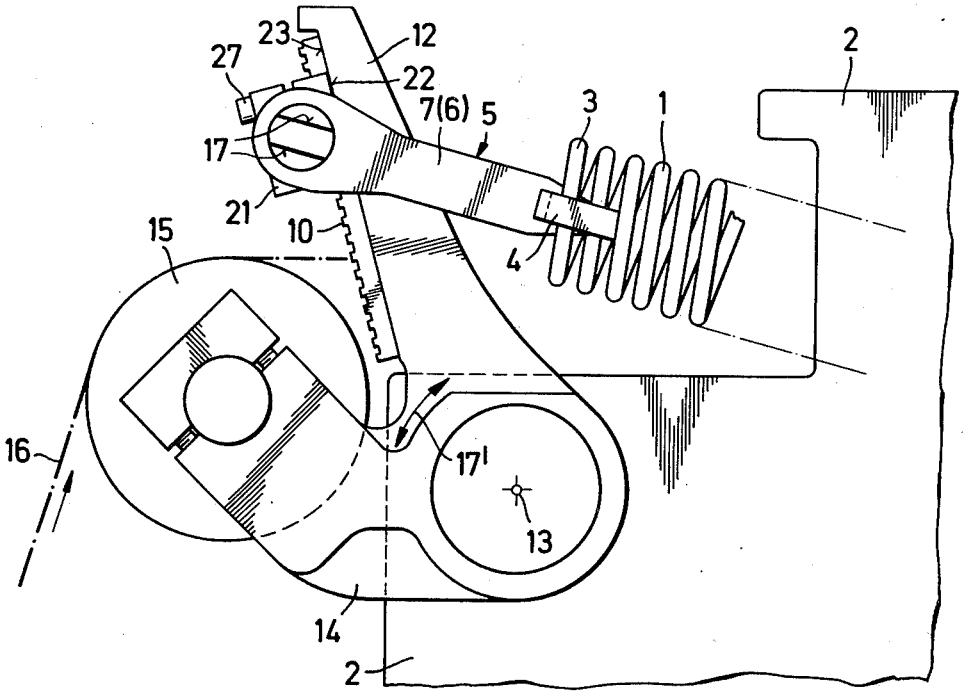
FIG. 1 illustrates a view of a mounting according to the invention.

Referring to FIG. 1, the mounting for a tension beam 15 is disposed on a cheek 2 of a weaving machine to permit a plurality of warp threads 16 to pass over the tension beam 15 in a tensioned state. As illustrated, the mounting includes a two-arm tension lever which is pivotally mounted on the cheek 2 to pivot about an axis 13 in the direction indicated by the arrow 17'. As indicated, one arm 14 of the lever receives the tension beam 15 thereon in a conventional manner. The other arm 12 of the lever extends upwardly as indicated.

The mounting also includes an accumulator in the form of a spring 1 which is fastened to the cheek 2 at the right hand end in a manner not shown.

Figure 3:
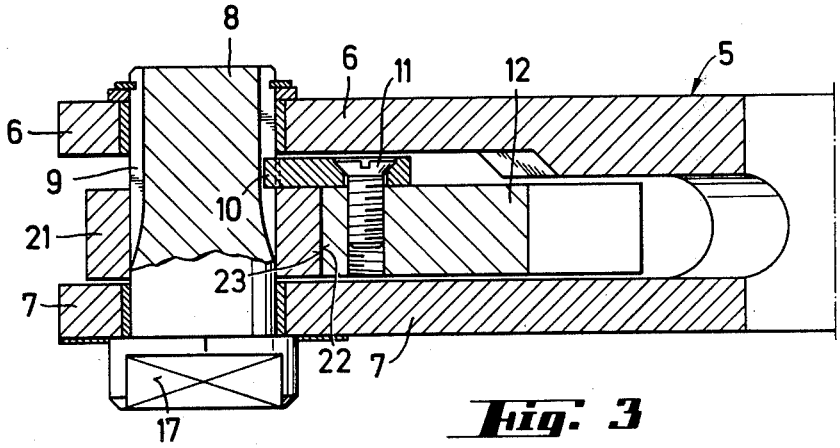
FIG. 3 illustrates a view taken on line III—III of FIG. 2

Further, a steplessly adjustable connection means is disposed between the left hand end of the spring 1 and the arm 12 of the tension lever for adjusting the point of connection 24 of the spring 1 to the arm 12 so as to adjust the tension of the tension beam 15. This connection means includes a rod-shaped member 5 such as a draw fork having two arms 6, 7 which is connected to the end 3 of the spring 1 via a flange 4 which spans the spring 1. In addition as shown in FIG. 3, the connection means includes a rotatable tooth element in the form of a pinion 9 having a shaft 8 rotatably mounted in the arms 6, 7 of the draw fork 5 and a toothed member in the form of a serration 10 on the arm 12 of the tension lever. The pinion 9 is disposed so as to be in meshing engagement with the serration 10.

Figure 2:
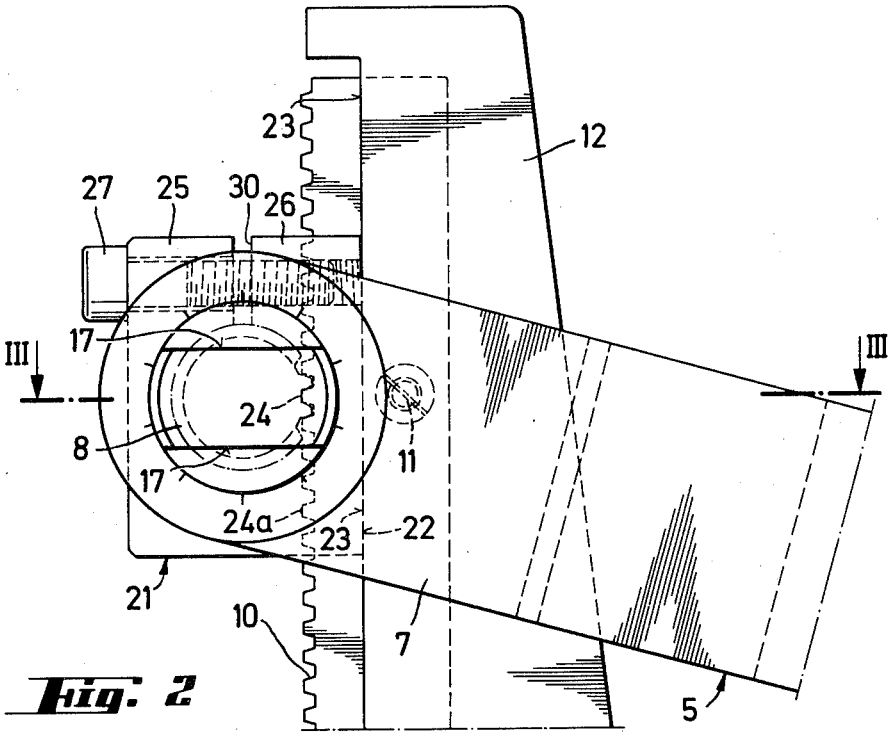
FIG. 2 illustrates a detail of the mounting of FIG. 1 on a larger scale.

Referring to FIGS. 2 and 3, the serration 10 is mounted on the arm 12 via one or more screws 11.

Referring to FIGS. 2 and 3, the connection means also includes a clamping means for restraining rotation of the pinion 9 relative to the draw fork 5 and serration 10. As shown, the clamping means includes a sliding block 21 which is releasably clamped about the shaft 8 of the pinion 9 in fixed relation. This block 21 includes a surface 22 which is disposed in sliding relation with a sliding surface 23 on the arm 12 so as to prevent rotation of the block 21 and the clamped shaft 8 of the pinion 9. Further, the sliding block 21 has a slot 30 so as to divide the upper end, as viewed, into two cheeks 25, 26. A screw 27 is passed through the cheeks 25, 26 in a manner so as to permit the cheeks 25, 26 to be brought together so as to clamp the block 21 on the shaft 8.

Referring to FIG. 3, the pinion 9 includes a shaped bore 17 such as a square bore in one end so as to receive a turning tool to permit rotation of the pinion 9 when desired.

During operation, the tension lever 12, 14 with the tension beam 15 can be pivoted back and forth in the direction indicated by the arrow 17' depending upon the fluctuating warp tension, for example during the throw of a reed in the weaving machine. In order to adjust the point of engagement 24 of the pinion 9 in the serration 10 and, hence, for adjusting the torque exerted by the spring 1 on the beam 15, the screw 27 of the clamping means must first be unthreaded so that the sliding block 21 is no longer coupled for rotation with the shaft 8. Next, a suitable turning tool is inserted into the square bore 17 of the shaft 8 and the pinion 9 is turned to move on the serration 10 to take up a new engagement position, for example at 24*a*. During this time, the face 22 of the sliding block 21 slides along the surface 23 of the arm 12. Next, the screw 27 is tightened to fix the new position of the connection means. In this condition, the connection means is fixed and the pinion 9 cannot be moved out of the new connection 24*a*, for example due to vibrations during operation.

The mounting may be such that the teeth of the pinion 9 and of the serration 10 can serve essentially only for adjustment while the pulling force generated by the spring 1 is transmitted by the sliding block 21 via the surfaces 22, 23.

The accumulator may also be in the form of a drawing weight instead of a spring. Further, instead of using a pinion 9 and the serration 10, the toothed member may be in the form of a serration while the tooth element is in the form of a worm. Alternatively, the toothed member may be appropriately threaded to cooperate with a tooth element in the form of a screw.

What is claimed is:

1. A mounting for a tension beam of a weaving machine, said mounting comprising a pivotally mounted two arm tension lever having one arm for receiving a tension beam thereon;

a serration mounted on a side of a solid second arm of said tension lever;

an accumulator for generating a tension force in said lever;

a tooth element between said accumulator and said second arm and steplessly cooperating with said serration to permit adjustment of a torque exerted by said accumulator on a tension beam mounted on said one arm of said tension lever without bringing the tension beam into a tensionless position; and releaseable clamping means to restrain movement of said tooth element relative to said serration.

2. A mounting as set forth in claim 1 which further comprises a rod-shaped member connected to said accumulator and wherein said tooth element is mounted on one end of said member.

3. A mounting as set forth in claim 1 wherein said tooth element has a shaft and said second arm has a sliding face and which further comprises a sliding block mounted about said shaft of said tooth element for rotating therewith, said block having a surface slidably disposed on said sliding face of said second arm.

4. A mounting as set forth in claim 3 wherein said shaft is fixable.

5. A mounting for a tension beam of a textile machine, said mounting comprising a pivotally mounted two-arm tension lever having one arm for receiving a tension beam thereon;

an accumulator pivoting said lever in a given direction; and a steplessly adjustable connection means between said accumulator and a second arm of said lever for adjusting the point of connection of said accumulator to said second arm to adjust the tension of a tension beam on said one arm, said connection means including a serration on said second arm and a pinion connected to said acccumulator in meshing engagement with said serration.

6. A mounting as set forth in claim 5 wherein said serration is fixed to said second arm and said pinion is rotatably mounted.

7. A mounting as set forth in claim 5 wherein said connection means includes a road-shaped member connected to said accumulator, and wherein said pinion is mounted on one end of said member.

8. A mounting as set forth in claim 7 wherein said pinion includes a shaft and said connection means includes a sliding block releaseably clamped about said shaft in fixed relation therewith, said block having a surface disposed in sliding relation with said second arm to prevent rotation of said block and said clamped shaft of said pinion.

9. A mounting for a tension beam of a weaving machine, said mounting comprising a pivotally mounted tension lever having one arm for receiving a tension beam thereon;

means defining a serration mounted on a second arm of said tension lever;

an accumulator for generating a tension force in said lever;

a rod-shaped member connected to said accumulator; and a tooth element mounted on one end of said member between said accumulator and said second arm and steplessly cooperating with said serration to permit adjustment of a torque exerted by said accumulator on a tension beam mounted on said one arm of said tension lever.

10. A mounting for a tension beam of a weaving machine, said mounting comprising a pivotally mounted tension lever having one arm for receiving a tension beam thereon and a second arm having a sliding face;

means defining a serration mounted on said second arm of said tension lever;

an accumulator for generating a tension force in said lever;

a tooth element between said accumulator and said second arm and steplessly cooperating with said serration to permit adjustment of a torque exerted by said accumulator on a tension beam mounted on said one arm of said tension lever, said tooth element including a rotatable shaft; and a sliding block mounted about said shaft of said tooth element for rotating therewith, said block having a surface slidably disosed on said sliding face of said second arm.

11. A mounting for a tension beam of a textile machine, said mounting comprising a pivotally mounted two-arm tension lever having one arm for receiving a tension beam thereon;

an accumulator pivoting said lever in a given direction; and a steplessly adjustable connection means between said accumulator and a second arm of said lever for adjusting the point of connection of said accumulator to said second arm to adjust the tension of a tension beam on said one arm, said connection means including a toothed member on said second arm, a rotatable tooth element connected to said accumulator in meshing engagement with said toothed member and releaseable clamping means for restraining rotation of said tooth element.

12. A mounting as set forth in claim 11 wherein said toothed member is a serration and said tooth element is a worm.

13. A mounting as set forth in claim 11 wherein said toothed member is threaded and said tooth element is a screw.

* * * * *

UNITED STATES PATENT AND TRADEMARK OFFICE

CERTIFICATE OF CORRECTION

PATENT NO. : 4,320,784

DATED : March 23, 1982

INVENTOR(S) : Eberhard Seifert

It is certified that error appears in the above—identified patent and that said Letters Patent is hereby corrected as shown below:

Column 4, line 19 change "road-shaped" to --rod-shaped--.

Signed and Sealed this

*Third* Day of *August 1982*

[SEAL]

*Attest:*

GERALD J. MOSSINGHOFF

*Attesting Officer*

*Commissioner of Patents and Trademarks*